United States Patent [19]

Goralski

[11] 4,137,670

[45] Feb. 6, 1979

[54] HAND FILE BOARD WITH A CENTRAL HANDLE

[75] Inventor: Edwin A. Goralski, St. Paul, Minn.

[73] Assignee: Minnesota Mining and Manufacturing Company, St. Paul, Minn.

[21] Appl. No.: 840,615

[22] Filed: Oct. 11, 1977

[51] Int. Cl.[2] ..... B24D 15/04

[52] U.S. Cl. ..... 51/392; 29/80

[58] Field of Search ..... 51/392, 393, 20 SR; 29/80; 145/19, 61 C

[56] References Cited

U.S. PATENT DOCUMENTS

| | | | |
|---|---|---|---|
| 1,177,520 | 3/1916 | Hoffmann | 29/80 |
| 1,448,775 | 3/1923 | Trump | 145/19 |
| 2,076,836 | 4/1937 | Goldblatt | 145/61 C |
| 2,124,615 | 7/1938 | Foltz | 145/61 C |
| 2,280,767 | 4/1942 | Ferragano | 51/393 |
| 2,434,356 | 1/1948 | Finkelstein | 51/392 X |
| 2,743,504 | 5/1956 | Hoyt | 29/80 |
| 3,842,548 | 10/1974 | Stoneburner | 51/392 |

*Primary Examiner*—Nicholas P. Godici

*Attorney, Agent, or Firm*—Cruzan Alexander; Donald M. Sell; William L. Huebsch

[57] ABSTRACT

A hand file board of the type used in repairing damage to the bodies of automobiles. The hand file provides a firm elongate planar support surface against which a sheet of abrasive material may be secured, and front and rear handles which can be used for manipulating the file to shape, sand, or scuff a surface with abrasive material supported on the file board. A central handle is provided between the front and rear handles, which central handle is disposed generally parallel with the abrasive support surface and is specially shaped for firm grasping by either hand to allow one handed use of the file board for light sanding or scuffing or when it is awkward or impossible to use two hands on the file board.

6 Claims, 6 Drawing Figures

HAND FILE BOARD WITH A CENTRAL HANDLE

BACKGROUND OF THE INVENTION

The present invention relates to the handles on hand file boards of the type adapted to support sheets of abrasive material and used in the repair of body damage on vehicles.

Hand file boards of the type used in repairing body damage on vehicles conventionally include a rigid portion having a firm elongate rectangular surface, a firm resilient pad which overlays the firm rectangular surface and provides an elongate planar abrasive support surface against which a sheet of abrasive material may be secured. The rigid portion also includes front and rear handles upstanding from the side of the file board opposite its abrasive support surface, with each of the handles adjacent a different end of the planar surface. Normally, the front handle is adapted to be received in the palm of a user's hand to afford guiding the direction of travel of the board and applying pressure between the abrasive material and a surface being abraded, whereas the rear handle is typically inclined upwardly at about a 45 degree included angle toward the front handle and is adapted to be grasped and pressed against by the palm of the other hand and to provide the major driving force for moving abrasive on the file board over the surface being abraded. Normally the file board is driven along the surface to be abraded with the front handle leading and with its longitudinal axis disposed at about a 45 degree angle with respect to its direction of travel so that the abrasive material on the file board will not form scratches corresponding to its longitudinal edges. In this manner the hand file board is typically used to shape or sand plastic filler which has been used to rebuild the contour of a damaged body member on a vehicle (such as an automobile) or to scuff and sand the surface of primers or putties applied over the shaped plastic filler material in preparation for applying the final finish to the vehicle.

While two hand usage of the hand file board is normally preferred for heavy removal of plastic filler, subsequent scuffing and sanding of the surfaces of putties or primers often can be done with one hand. Additionally, abrading surfaces of vehicle body portions adjacent the ground (such as the lower portion of doors or fenders) may be difficult or impossible to do with two hands such as when the user is bending over and must brace himself against the vehicle. When such one handed use has been desired, however, users of prior art file boards have been forced to either guide the file board by grasping only one of its handles (neither of which provides a suitable balance for use of the tool or the desired ability to accurately guide its direction of travel) or by grasping a central portion of the file board which does not provide a suitable grip.

SUMMARY OF THE INVENTION

According to the present invention there is provided a hand file board of the type described above which, in addition to the conventional front and rear handles, includes a central handle adapted to be grasped by a user to facilitate use of the tool during light stock removal or when it is difficult or impossible for the user to grasp the tool with both hands, which central handle is specially shaped to give the user good one-handed control of the file board.

Like the prior art hand file board described above, the hand file board according to the present invention includes a rigid portion having a firm elongate planar surface, a firm resilient pad which overlays the rectangular surface on the rigid portion and provides an elongate planar abrasive support surface against which a sheet of abrasive material may be secured. The rigid portion also includes two handles upstanding from the side of the file board opposite its abrasive support surface, with each of the handles adjacent a different end of the planar surface.

In the hand file board according to the present invention, however, the rigid portion also includes a portion providing a third central handle between the normal front and rear handles, which central handle is specially adapted to allow one handed use of the board. The central handle is elongate, has a shape specially adapted to be grasped with the thumb and fingers of either of a user's hands, and is disposed generally parallel with the abrasive supporting surface.

In a preferred embodiment, the central handle has opposed top and bottom surfaces which are generally cylindrically convex about an axis transverse and parallel to the abrasive support surface. The handle has opposed side surfaces which are generally cylindrically convex about an axis normal to the abrasive support surface, which side surfaces are contoured to receive the fingers and thumb on either hand of a user grasping the central handle. Also the rigid portion provides a curved surface at the end of the central handle adjacent the rear handle, which curved surface is adapted to receive the edge opposite the thumb of a hand grasping the central handle. This curved surface, together with the contoured edges of the central handle, provide a firm natural grip of the central handle by a user which helps the user to comfortably and accurately guide and apply force with the file board during one-handed usage thereof.

BRIEF DESCRIPTION OF THE DRAWING

The invention will be further described with reference to the accompanying drawing wherein like numbers refer to like parts in the several views, and wherein.

DESCRIPTION OF THE PREFERRED EMBODIMENT

Figure 1:
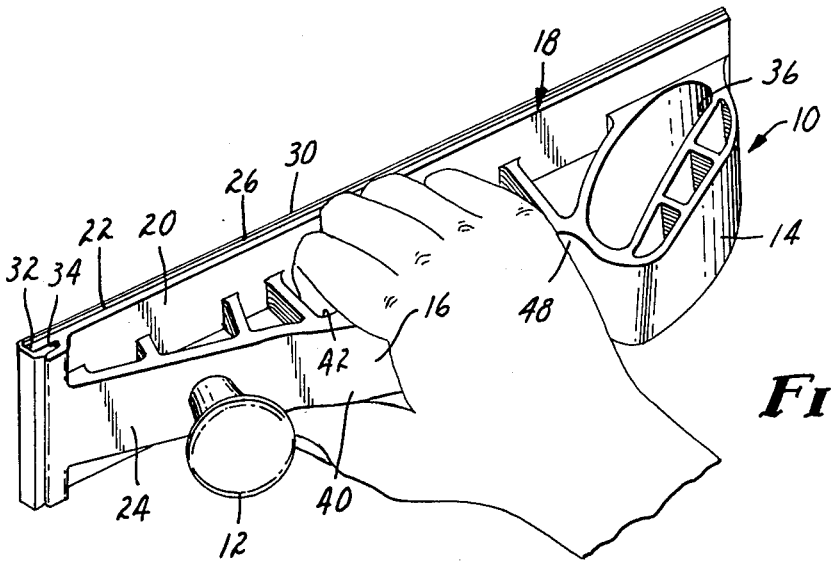
FIG. 1 is a perspective view of a hand file board according to the present invention being grasped by its central handle.

Referring now to the drawing there is illustrated a hand file board according to the present invention generally designated by the reference numeral 10. The hand file board 10 includes front and rear handles 12 and 14 to allow the hand file board 10 to be manipulated in a conventional manner, together with a novel third central handle 16 which allows convenient one hand manipulation of the hand file board as is illustrated in FIG. 1.

The hand file board 10 includes a rigid structure 18 molded of a rigid polymeric material (such as polypropylene). The rigid structure 18 is shaped to provide a plate-like portion 20 having a firm elongate rectangular planar surface 22 and a reinforcing portion 24 on the side of the plate-like portion 20 opposite the planar surface 22 on which are formed the front, rear and central handles 12, 14 and 16. The hand file board 10 also includes a thin rectangular pad 26 of an elastic material (such as rubber) fixed to the planar surface 22 of the rigid structure 18. The pad 26 provides an elongate rectangular abrasive support surface 28 against which a sheet of abrasive material 30 may be secured. As illustrated, the sheet of abrasive material 30 is adhered to the abrasive support surface 28 of the pad 26 by a pressure sensitive adhesive and has its leading end portion wrapped around a leading end 32 of the plate-like portion 20 and engaged in a transverse slot 34 defined by the rigid structure 18 as is described in U.S. Pat. No. 3,892,091.

The reinforcing portion 24 of the rigid structure 18 comprises thin intersecting ribs of the polymeric material which provide good rigidity, while restricting its maximum thickness, thereby conserving material and facilitating the injection molding process by which it is formed.

The front handle 12 is knob-like and is adapted to be received in the palm of the user's hand to allow the user to guide and apply pressure at the leading end of the hand file board 10. The rear handle 14 is elongate, supported at both ends, and disposed with its central axis at an acute included angle of about 45 degrees with the elongate axis of the plate-like portion 20. The rear handle 14 is spaced along its length from the adjacent portions of the rigid structure 18 to provide an opening 36 which allows the user to grasp the rear handle 14 with his thumb and fingers encircling the handle 14, and with the palm of his hand positioned to apply pressure against the outer surface of the rear handle 14 to propel the hand file board 10 along a surface to be abraded and to press the abrasive material 30 against that surface.

Figure 2:
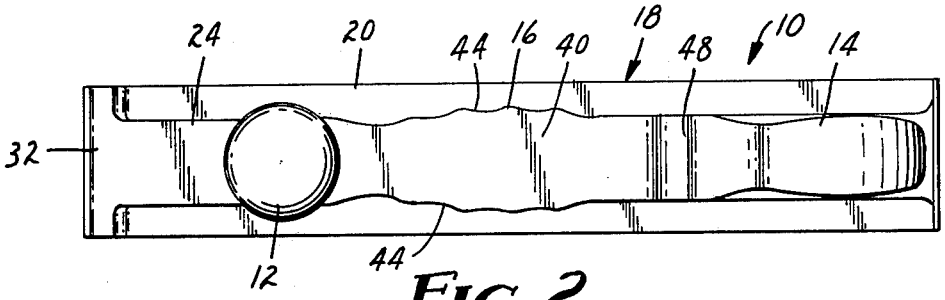
FIG. 2 is a top plan view of the hand file board of FIG. 1.
Figure 3:
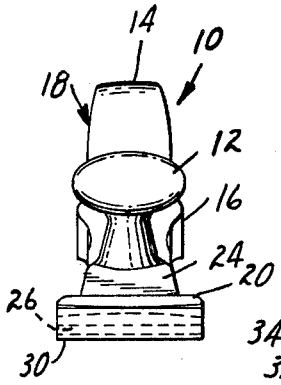
FIG. 3 is a front elevational view of the hand file board of FIG. 1.
Figure 4:
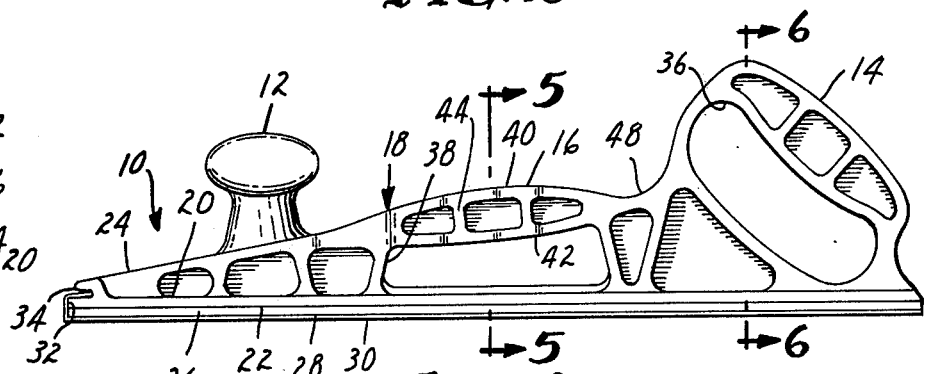
FIG. 4 is a side elevational view of the hand file board of FIG. 1.
Figure 5:
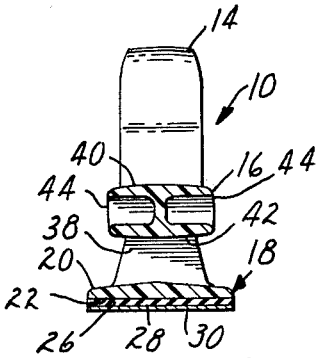
FIG. 5 is a sectional view taken approximately along line 5—5 of FIG. 4.
Figure 6:
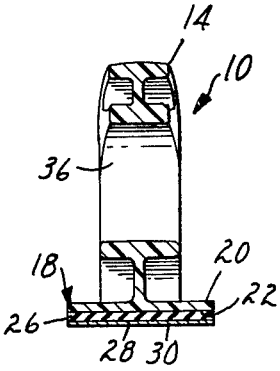
FIG. 6 is a sectional view taken approximately along line 6—6 of FIG. 4.

The central handle 16 is specially shaped to allow control of the hand file board 10 during one handed abrading operations. The central handle 16 is attached at its ends and spaced along its length from the adjacent portions of the rigid structure 18 to provide an opening 38 allowing the user to grasp the central handle 16 with his fingers encircling it. The central handle 16 has opposite top and bottom surfaces 40, 42 which are generally cylindrically convex about an axis transverse and parallel to the planar surface 28 against which the abrasive is supported, and has opposed side surfaces 44 which are generally cylindrically convex about an axis normal to the abrasive support surface 28. As is best seen in FIG. 2, the central handle 16 has generally sinuous undulations along its generally convex side surfaces 44, which undulations are adapted to receive the fingers and thumb of either of a user's hands when the user grasps the central handle 16. Additionally, the rigid structure 18 has a curved surface 48 at the end of the central handle 16 adjacent the rear handle 14, which curved surface 48 is adapted to receive the edge opposite the thumb of a hand grasping the central handle to help in controlling the hand file board 10.

While the hand file board 10 described above is a preferred embodiment, it will be appreciated that many changes could be made without departing from the spirit of the invention. For example the sheet of abrasive could be held on the file board by clamp assemblies at the ends of the file. Also the central handle could be supported from a central pedestal (as is the front handle 12) rather than from its ends.

I claim:

1. In a hand file board of the type including a rigid portion having a firm elongate surface, and a firm resilient pad which overlays said firm surface and has an elongate generally planar surface against which a sheet of abrasive material may be secured, said rigid portion including front and rear handles upstanding from its side opposite said firm elongate surface, with each of said handles adjacent a different one of its ends, the improvement wherein said rigid portion includes a fixed central handle between said front and rear handles, said central handle being elongate, being disposed generally parallel with and aligned longitudinally of said planar surface, and being shaped for firm comfortable grasping by the thumb and fingers of a user's hand, said rigid portion having a through opening between said central handle and said planar surface for receiving the fingers of the user grasping the central handle.

2. A hand file board according to claim 1 wherein said rigid portion has a curved surface with one end of the curved surface smoothly joining the outer surface of said central handle at its end adjacent said rear handle and the other end projecting away from said planar surface, said curved surface being adapted to receive the edge opposite the thumb of a hand grasping the central handle.

3. A hand file board according to claim 1 wherein said central handle has opposite top and bottom surfaces which are generally cylindrically convex about an axis transverse and parallel to said planar surface, and opposed side surfaces which are generally cylindrically convex about an axis normal to said planar surface, said side surfaces having undulations adapted to receive the fingers and thumb of a user grasping said central handle.

4. A hand file board according to claim 3 wherein said undulations along said side surfaces are generally sinuous.

5. In a hand file board of the type including a rigid portion having a firm elongate surface, and a firm resilient pad which overlays said firm surface and provides an elongate abrasive support surface against which a sheet of abrasive material may be secured, said rigid portion including front and rear handles upstanding from the side of said hand file opposite said abrasive support surface with each of said handles adjacent a different one of its ends, the improvement wherein said rigid portion is an integral polymeric molding, and includes a fixed central handle between said front and rear handles, said central handle being elongate, being attached at its ends and disposed generally parallel with and aligned longitudinally of said abrasive support surface, having opposite top and bottom surfaces which are generally cylindrically convex about an axis transverse and parallel to said abrasive support surface, and having opposed side surfaces which are generally cylindrically convex about an axis normal to said planar surface, said side surfaces having undulations adapted to receive the fingers and thumb of a user grasping said central handle, and said molding has a curved surface with one end of the curved surface smoothly joining the outer surface of said central handle at its end adjacent said rear handle and the other end projecting away from said abrasive support surface, said curved surface being adapted to receive the edge opposite the thumb of a hand grasping said central handle.

6. A hand file board according to claim 5 wherein said undulations along said side surfaces are generally sinuous.

* * * * *